United States Patent [19]

Hart et al.

[11] Patent Number: 4,694,599

[45] Date of Patent: Sep. 22, 1987

[54] ELECTROMAGNETIC FLIP-TYPE VISUAL INDICATOR

[75] Inventors: Robert D. Hart, Collinsville; John J. Ambrozaitis, Waterbury, both of Conn.

[73] Assignee: Minelco, Inc., Thomaston, Conn.

[21] Appl. No.: 802,647

[22] Filed: Nov. 27, 1985

[51] Int. Cl.[4] ..... G09F 9/00

[52] U.S. Cl. ..... 40/449; 340/764

[58] Field of Search ..... 40/449; 340/815.24, 340/815.27, 815.29, 764

[56] References Cited

U.S. PATENT DOCUMENTS

| | | | |
|---|---|---|---|
| 3,295,238 | 1/1967 | Winrow | 40/449 |
| 3,422,426 | 1/1969 | Bailey et al. | 340/815.24 |
| 3,624,941 | 12/1971 | Chantry | 40/449 |
| 4,259,801 | 4/1981 | Ito | 40/449 |

FOREIGN PATENT DOCUMENTS

| | | | |
|---|---|---|---|
| 2306067 | 9/1973 | Fed. Rep. of Germany | 40/449 |
| 3335922 | 4/1985 | Fed. Rep. of Germany | 40/449 |

*Primary Examiner*—Robert P. Swiatek
*Assistant Examiner*—Cary E. Stone
*Attorney, Agent, or Firm*—Pennie & Edmonds

[57] ABSTRACT

An electromagnetic indicator capable of binary indication including a rotatably mounted semicircular flag assembly which can rotate between a first position ("set") and a second position ("fault") upon the receipt by the indicator of an electrical signal. A portion of the flag assembly is permanently magnetized and is magnetically latched in either the "set" or "fault" position by a magnetic latch which is preferably comprised of a bracket and core bar. The bracket has two ends which are positioned so that they are adjacent the magnetized portion of the flag assembly. The core bar is magnetically connected to an electromagnet and is also positioned adjacent a magnetized portion of the flag assembly. When the electromagnet is connected to the appropriate terminal of an electrical power source, the electromagnet generates a magnetic field, magnetizes the two ends of the bracket means and the core bar, and causes the flag assembly to flip from the "set" position to the "fault" position, or vice versa. After the electromagnet is disconnected from source, the flag assembly is magnetically latched in either the "set" or "fault" position by the magnetic attraction between the bracket, and the core bar on the one hand and the magnetized portion of the flag assembly on the other hand.

26 Claims, 9 Drawing Figures

ELECTROMAGNETIC FLIP-TYPE VISUAL INDICATOR

TECHNICAL FIELD

The present invention relates to a form of electromagnetic indicator capable of binary indication for use as a component of a large display panel or as a fault condition indicator.

BACKGROUND OF THE INVENTION

For many applications, it is desirable to frequently change information appearing on large display panels. For example, at airports, at vehicle terminals and on highways, the travel conditions, and the arrival and departure times change constantly, and therefore the information appearing on display panels must be updated frequently.

By providing the display panel with an array of a large number of colored dots or indicators whose color can be selectively changed, information can be displayed on the panels by changing the color of certain dots or indicators to form numbers, or letters and words. Preferably, these dots or indicators are binary in that upon the receipt of an appropriate signal, the color of selected indicators changes from a background color (such as black) to a contrasting color (such as white) or vice versa thereby forming numbers or letters comprised of dots.

Such indicators are also useful individually to indicate a fault or malfunction condition in a device being monitored.

Although such indicators can be lights which can selectively be turned on and off, in order to minimize the power necessary to operate such indicators, binary indicators have been developed which when actuated by an electric signal generate an electromagnetic field which causes a flag or small panel to flip over. Each side of the flag is colored differently, so that when the flag flips the color displayed by the indicator changes. Examples of such binary electromagnetic indicators are disclosed in U.S. Pat. Nos. 1,191,023, 3,025,512 and 3,140,553.

SUMMARY OF THE INVENTION

The present invention relates to an electromagnetic indicator capable of binary indication. The indicator comprises a housing in which is mounted a flag assembly which can rotate between a first position ("set") and a second position ("fault") upon the receipt by the indicator of an appropriate electrical signal. A portion of the flag assembly is permanently magnetized. The flag assembly preferably comprises a semicircular disk or flag connected to a pivot shaft which is rotatably mounted within the housing. The magnetized portion of the flag assembly is preferably comprised of two or three separate magnets which are attached at different positions on the flag.

An electromagnetic means is mounted within the housing and comprises an electromagnet having a core and a winding. The winding is connectable to an electrical power source so that when the electromagnet is connected to the power source, the electromagnet generates a magnetic field.

A bracket means is connected to a first end of the electromagnet so that the entire bracket means assumes the magnetic polarity of the first end of the electromagnet to which it is attached when the electromagnet is connected to the power source. The bracket means preferably has two ends which are positioned within the housing so that the ends are adjacent the magnetized portion of the flag assembly when the flag assembly is in either the "set" or "fault" position.

When the electromagnet is connected to the correct terminal of the power source, the electromagnet magnetizes the bracket means and its two ends, and the flag assembly flips from the "set" position to the "fault" position, or vice versa due to the magnetic repulsion between the flag magnets on the one hand and the ends of the bracket means and the electromagnet on the other hand. After the electromagnet is disconnected from the power source, the flag assembly is magnetically latched in either the "set" or "fault" position by the magnetic attraction between the magnetized portion of the flag assembly and the bracket means. A ferrous metal core bar is attached to the second end of the electromagnet. The ferrous metal core bar assumes the magnetic polarity of the second end of the electromagnet, thus aiding in the flipping and latching of the flag assembly.

An advantage of the present invention is that the entire device has only a single moving part, the flag assembly. Since the flag assembly is magnetically latched in both the "set" and "fault" positions even after the power source is disconnected, power utilization is minimized. Depending on the strength of the magnets used, the indicator can operate in virtually any position. Since magnetic latching is used instead of mechanical latching, the number of moving parts is minimized and, therefore, the expected useful life of the indicator will not depend primarily upon mechanical failure of any of the elements of the indicator.

BRIEF DESCRIPTION OF THE DRAWINGS

These and other objects, features, elements, and advantages of the invention will be more readily apparent from the following description of the invention in which.

DESCRIPTION OF THE PREFERRED EMBODIMENT

Figures 1, 8:
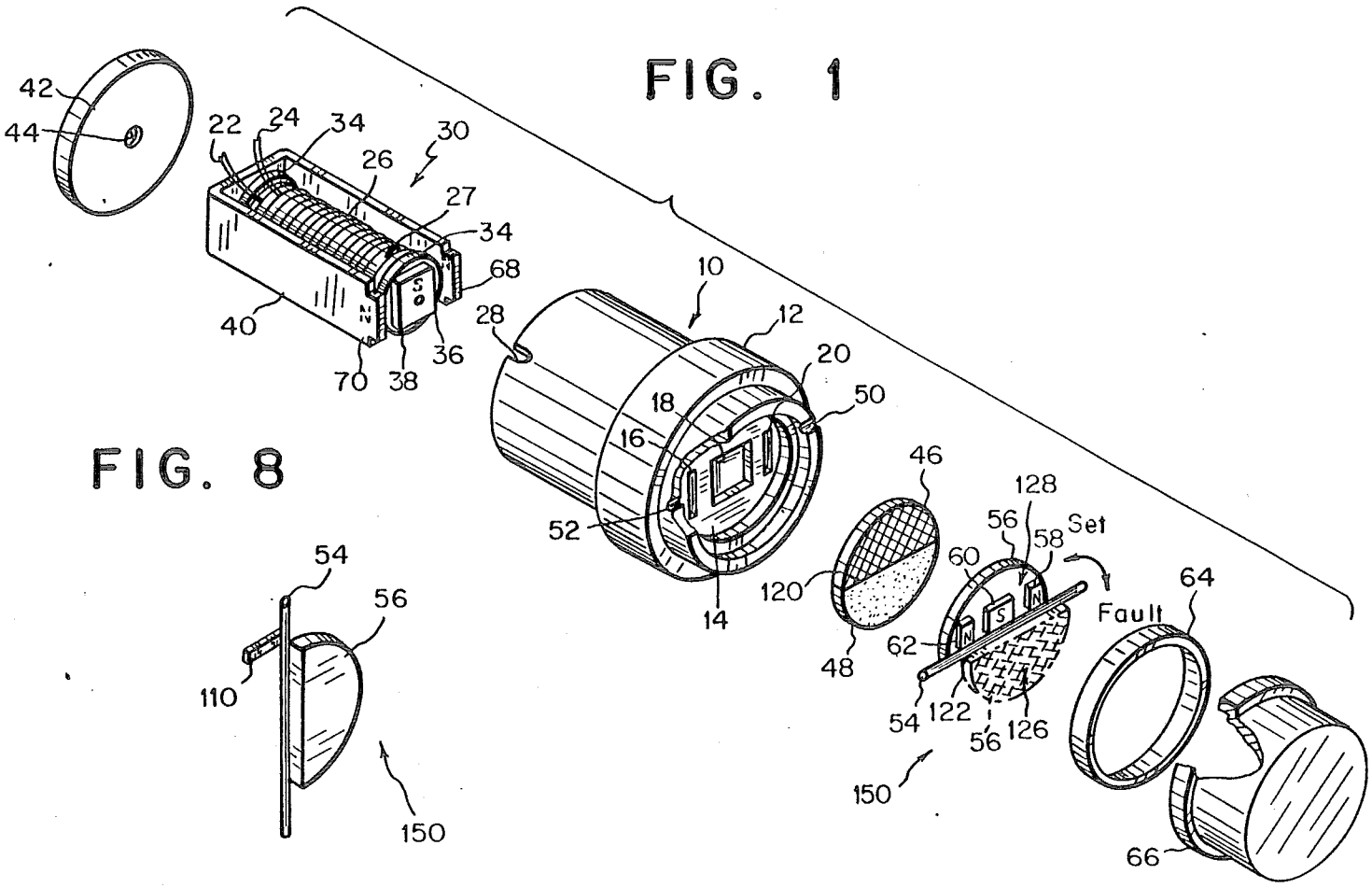
FIG. 1 is an exploded perspective drawing of a preferred embodiment of the electromagnetic flip-type visual indicator of the present invention.
FIG. 8 is another embodiment of the flag assembly of the indicator of the present invention.
Figure 3:
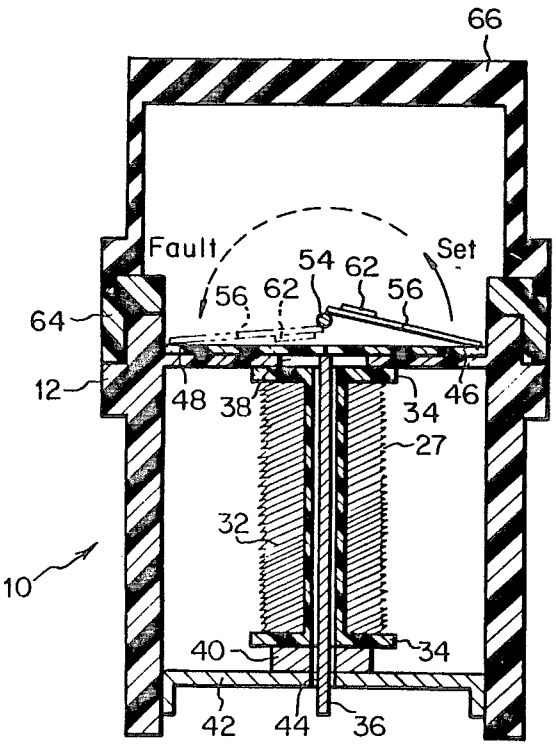
FIG. 3 is a side elevation of the structural components of FIG. 2 rotated through an angle of 90°.
Figure 2:
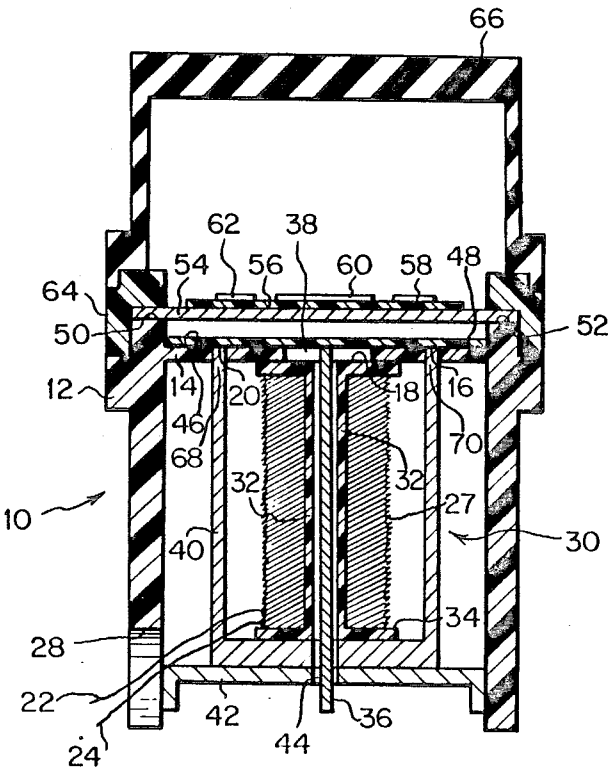
FIG. 2 is a side elevation in vertical section of the preferred embodiment of the electromagnetic flip-type visual indicator of FIG. 1.

With reference to FIGS. 1, 2 and 3 the indicator includes a housing 10 which has an overall cylindrical shape and an exterior flange 12 near a first end of housing 10. The first end of housing 10 is partially closed by an end portion 14 through which pass three rectangular holes 16, 18, 20. Additionally, the first end of housing 10 is provided with two grooves 50, 52 disposed along the circumference of housing 10 so that a line connecting the grooves 50, 52 intersects the axis of housing 10. The first end of housing 10 shown in FIG. 1 is partially cut away in order that rectangular holes 16, 18, 20 may be seen. The exterior surface of the second end of housing 10 may be threaded so that the indicator may be mounted on and secured to a panel such as by a threaded lock nut to draw the flange toward the panel. Alternatively, the housing may be unthreaded and may be secured to a panel by an adhesive or other means as are known to those skilled in the art. The second end of housing 10 has an opening 28 through which the two ends 22, 24 of wire 26 can pass.

For reasons that will become apparent, housing 10 is preferably fabricated of a non-magnetic metal or of a plastic having the characteristics of strength, rigidity and impact strength among others as is appropriate for use as a support structure.

A magnetic assembly 30 is received and fixed within housing 10. Magnetic assembly 30 includes a bobbin 32 (shown in FIGS. 2 and 3) fabricated of an insulating material, for example, plastic. A coil 27 is formed by winding wire 26 a number of turns on bobbin 32 within a region bounded at opposite ends by flanges 34. The number of turns of coil 27 and the gauge of wire 26 will be determined by factors, such as the power of the source of the input, the desired resistance and other operational factors as are well known. Bobbin 32 is mounted on core member 36 which is disposed within the central hollow of bobbin 32. A first end of core member 36 passes through and is fixed within a hole in bracket 40. A second end of core member 36 extends beyond flange 34 and is connected to core bar 38. Thus bobbin 32 is mounted on core member 36 between core bar 38 and bracket 40.

Core bar 38 is flat and rectangular in shape, is preferably a ferrous metal bar and is positioned on one flange 34 of bobbin 32. Bracket 40 is U-shaped and is formed of a single piece of flat material, preferably ferrous metal, that is bent into a U-shape. Core bar 38 and bracket 40 are preferably comprised of ferrous metal so that they can assume a magnetic polarity for reasons as will become apparent. Core bar 38 and bracket 40 can be comprised of other materials which can assume a magnetic polarity. When coil 27 is appropriately pulsed, ends 68, 70 of bracket 40 become magnetized with one polarity while core bar 38 becomes magnetized with an opposite polarity, as shown in FIG. 1.

Magnetic assembly 30 is mounted within housing 10 so that the end 68 of bracket 40 is mounted into rectangular hole 20 of end portion 14, end 70 of bracket 40 is mounted into rectangular hole 16 of end portion 14, and core bar 38 is mounted into rectangular hole 18 of end portion 14. Cap 42 is inserted into the second end of housing 10 so that the two ends 22, 24 of wire 26 pass through opening 28 and so that magnetic assembly 30 is completely enclosed within housing 10. Cap 42 has a hole 44 at its center through which the second end of core member 36 protrudes.

End portion 14 is completely covered by two semicircular segments 46, 48 which are attached to end portion 14 by a pressure sensitive adhesive so that the straight edges 120 of semicircular segments 46, 48 are parallel to a line which connects grooves 50, 52. The surfaces of semicircular segments 46, 48 not in contact with end portion 14 are colored so that the color of the exposed surface of segment 46 contrasts highly with the color of the exposed surface of segment 48. Illustratively, the exposed surface of segment 46 is orange and the exposed surface of segment 48 is black. Segments 46, 48 are preferably fabricated of a non-magnetic material such as Mylar.

The ends of pivot shaft 54 are rotatably mounted in grooves 50, 52 of housing 10. Semicircular flag 56 is fixed to pivot shaft 54 along its straight edge and is preferably fabricated of a non-magnetic material such as Mylar. In FIGS. 1 and 3 semicircular flag 56 is shown in the "set" position in solid lines and in the "fault" position in broken lines. Flag 56 is approximately the same size and shape as one of segments 46, 48 and is mounted so that flag 56 completely covers either segment 46 or segment 48. Thus, when segment 46 is completely covered by flag 56 as shown in solid lines in FIGS. 1 and 3, the "set" position, the color of surface 128 of flag 56 directed away from segment 46 matches the color of segment 48. Similarly, when segment 48 is completely covered by flag 56 as shown in broken lines in FIGS. 1 and 3, the "fault" position, the color of surface 126 of flag 56 directed away from segment 48 matches the color of segment 46. As a result, when flag 56 is in one of these two positions, the indicator displays a single color, either black for "set" or orange for "fault", for example.

Figure 6A:
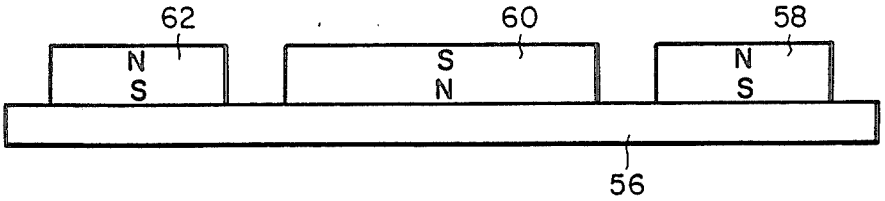
FIG. 6*a* is a cross-sectional view of one embodiment of the flag and flag magnet assembly of the indicator of the present invention.

Permanent flag magnets 58, 60, 62 are rectangular in shape, are fixed in a line to surface 128 of flag 56, and are magnetized so that the surfaces in contact with flag 56 of flag magnets 58, 60, 62 are magnetically polarized having alternating poles (south-north-south) while the other surfaces of the magnets have the three opposite poles (north-south-north) as shown in FIG. 6*a*. Flag magnets 58, 60, 62 are attached to flag 56 adjacent the straight edge 122 of flag 56 in a line that is parallel to the straight edge 122 of flag 56.

Figure 6B:
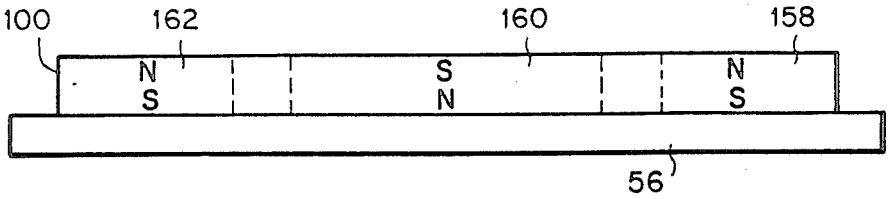
FIG. 6*b* is a cross-sectional view of a second embodiment of the flag and flag magnet assembly of the indicator of the present invention.

Surface 128 of flag 56 and flag magnets 58, 60, 62 are colored so that the color of surface 126 of flag 56 to which flag magnets 58, 60, 62 are not attached contrasts highly with the exposed surface of flag magnets 58, 60, 62 and the other surface of flag 56. Illustratively, flag magnets 58, 60, 62 and surface 128 of flag 56 to which they are attached are black and surface 126 of flag 56 is orange. Illustratively, segments 46, 48, flag 56 and flag magnets 58, 60, 62 are painted with non-magnetic paint such as a rubber base paint. Alternatively, colored tape can be used. Although flag magnets 58, 60, 62 are shown in FIGS. 1, 2, and 6*a* as three discrete magnets, these magnets can alternatively be magnetized regions 158, 160, 162 of a single magnetic strip 100 which is appropriately magnetized as shown in FIG. 6*b*. Pivot shaft 54, flag 56, and flag magnets 58, 60, 62 comprise flag assembly 150.

Ring 64 is mounted and secured onto the first end of housing 10 so that pivot shaft 54 is locked into grooves 50, 52. Ring 64 is fabricated of a non-magnetic material such as plastic or rubber. Lens cap 66 is mounted and secured onto ring 64 so that flag 56 is completely sealed within the cavity formed by housing 10 and lens cap 66. The shape of lens cap 66 is such that flag 56 can rotate about the axis of pivot shaft 54 without interference by lens cap 66. Lens cap 66 is preferably fabricated of a transparent non-magnetic material such as plastic or glass. In FIG. 1, lens cap 66 shown in FIG. 1 is partially cut away to show that lens cap 66 is a hollow cylinder closed off at one end. Although lens cap 66 is shown as having a flat top, it may alternatively have a domed top. If the indicator is used as part of a large display panel comprised of a plurality of indicators, lens cap 66 can be omitted provided that the entire display panel is enclosed by a transparent cover so that air currents and other environmental factors will not interfere with the proper operation of the indicator.

Figure 4:
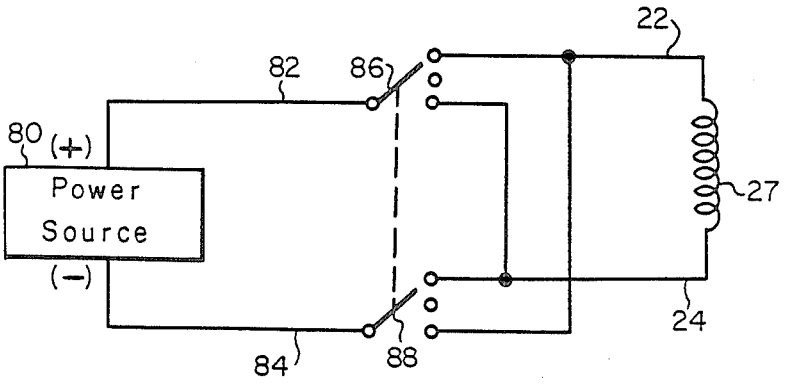
FIGS. 4 and 5 are schematic diagrams of electrical circuits, which can be used with the indicator of the present invention.
Figure 5:
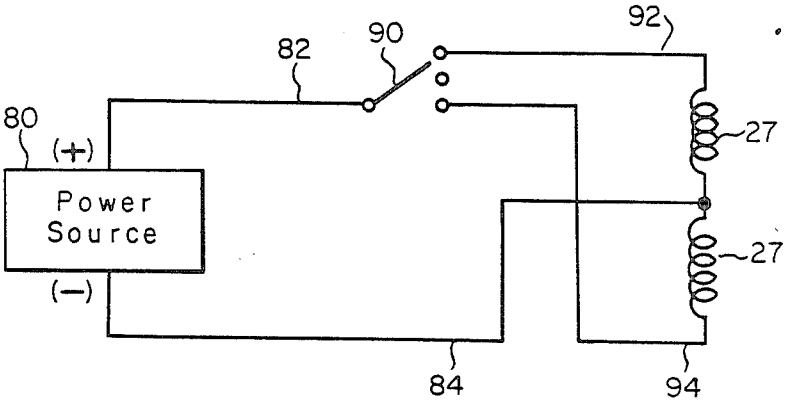

FIGS. 4 and 5 illustrate possible circuit arrangements for connecting the indicator of the present invention to an electrical power supply. Referring to FIG. 4, the high voltage output of power source 80 is connected to a first terminal of single pole multiple throw switch 86 by wire 82, while the low voltage output of power source 80 is connected to a first terminal of single pole multiple throw switch 88 by wire 84. The second and third terminals of switches 86, 88 are connected to ends 22, 24 of wire 26 of coil 27. Switches 86, 88 are ganged together so that when switch 86 is in a first position whereby wire 82 is connected to wire 22, switch 88 is also in a first position whereby wire 84 is connected to wire 24; while when switch 86 is in a second position, wire 82 is connected to wire 24, and switch 88 is also in a second position whereby wire 84 is connected to wire 22. For reasons as will become apparent, switches 86, 88 are preferably momentary contact switches which connect power source 80 to coil 27 momentarily. As a result of the circuit arrangement shown in FIG. 4, when switches 86, 88 are in the first position, a magnetic pulse is generated by coil 27 in a first direction, while a magnetic pulse is generated by coil 27 in an anti-parallel second direction when switches 86, 88 are in the second position. The importance of selectively producing magnetic pulses in different directions will become apparent in the following discussion regarding the operation of the indicator.

FIG. 5 shows an alternative circuit arrangement which uses only one single pole multiple throw momentary contact switch 90. Coil 27, however, is a center tapped coil and therefore has three wires 84, 92, 94 connected to it. Similarly, when switch 90 is in a first position, coil 27 generates a magnetic pulse in a first direction while when switch 90 is in a second position, coil 27 generates a magnetic pulse in an anti-parallel second direction. Other circuit arrangements will be apparent to those skilled in the art.

In operation, when flag 56 is in either the "set" or "fault" position, the magnetic attraction between flag magnets 58, 60, 62 on the one hand and the ends 68, 70 of bracket 40 and core bar 38 on the other hand latch flag 56 in either of these two positions. As a result, flag magnet 58 is magnetically attracted to end 68 of bracket 40, flag magnet 60 is magnetically attracted to core bar 38, and flag magnet 62 is magnetically attracted to end 70 of bracket 40. Ends 68, 70 of bracket 40 and core bar 38 will frequently remain magnetized from a previous operation of the indicator and will thus aid in magnetically latching flag 56. Although the magnetic polarities of ends 68, 70 of bracket 40 and core bar 38 will change depending upon the magnetization of coil 27, for illustrative purposes, ends 68, 70 are shown as having north (N) poles while core bar 38 is shown as having a south (S) pole. Since bracket 40 and ends 68, 70 are magnetically connected to the first end of the electromagnet while core bar 38 is magnetically connected to the second end of the electromagnet, ends 68, 70 will always have an opposite magnetic pole from that of core bar 38.

Thus, when flag 56 is in the "set" position as shown in solid lines in FIGS. 1 and 3, the south pole of flag magnet 58 attracts the north pole of end 68 of bracket 40; the north pole of flag magnet 60 attracts the south pole of core bar 38; and the south pole of flag magnet 62 attracts the north pole of end 70 of bracket 40. Similarly, when flag 56 is in the "fault" position shown in broken lines in FIGS. 1 and 3, the north pole of flag magnet 58 attracts the south pole of end 68 of bracket 40; the south pole of flag magnet 60 attracts the north pole of core bar 38; and the north pole of flag magnet 62 attracts the south pole of end 70 of bracket 40.

In order to change the position of flag 56 from one of its latched positions to the other, power source 80 is momentarily connected to coil 27 by switches 86, 88 (or switch 90) so that an appropriately directed magnetic field is produced by coil 27. When flag 56 is in the "set" position as shown in solid lines in FIGS. 1 and 3, and it is desired to change the position of flag 56 to the "fault" position as shown in broken lines in FIGS. 1 and 3, switches 86, 88 (or switch 90) connect power source 80 to coil 27 so that the end of coil 27 near core bar 38 has a north magnetic pole. Core bar 38 assumes a north magnetic pole, thereby repelling the north pole of flag magnet 60. In addition, bracket 40 becomes magnetized by coil 27 so that bracket 40 assumes a south magnetic pole. As a result, ends 68, 70 also assume a south magnetic pole thereby repelling the south poles of flag magnets 58, 62. The repulsive magnetic forces cause flag 56 to rotate from the "set" position to the "fault" position.

After flag 56 has passed the midpoint between its "set" and "fault" positions, the rotation of flag 56 is aided by the attractive forces between flag magnet 62 (north) and end 70 (south), between flag magnet 60 (south) and core bar 38 (north); and between flag magnet 58 (north) and end 68 (south). Coil 27 must be connected to power source 80 by switches 86, 88 (or switch 90) for a long enough time so that flag 56 flips from the "set" to the "fault" position. Once flag 56 has rotated into the "fault" position, the magnetic attractive forces between flag magnets 58, 68, 62 on the one hand, and ends 60, 70 and core bar 38 on the other hand cause flag 56 to be latched in the "fault" position after coil 27 is disconnected from power source 80. As previously mentioned, after coil 27 has been disconnected from power source 80, ends 68, 70 and core bar 38 maintain their magnetic polarities until the indicator is operated again by connecting coil 27 to the opposite terminal of power source 80, as discussed below. If ends 68, 70 and core bar 38 should lose their magnetic polarity, flag 56 will continue to be latched in position due to the magnetic attraction between the flag magnets on the one hand and the ferrous metal comprising ends 68, 70 and core bar 38 on the other hand.

In order to reset the indicator by causing flag 56 to flip from the "fault" position to the "set" position, switches 86, 88 (or switch 90) connects power source 80 to coil 27 so that the end of coil 27 near core bar 38 has a magnetic south pole thereby magnetizing core bar 38 with a south polarity and repelling the south pole of flag magnet 60. Additionally, coil 27 causes bracket 40 and ends 68, 70 to assume a north polarity thereby repelling flag magnets 58, 62 which also have a north polarity.

The repulsive forces between flag magnets 60, 58, 62 on the one hand and coil 27, ends 68, 70 and core bar 36 on the other hand cause flag 56 to rotate into the "set" position. Attractive forces between flag magnets 58, 60, 62 on the one hand and ends 68, 70, core bar 38 and coil 27 similarly aid the rotation of flag 56 into the "set" position, and latch flag 56 in that position.

Figure 7:
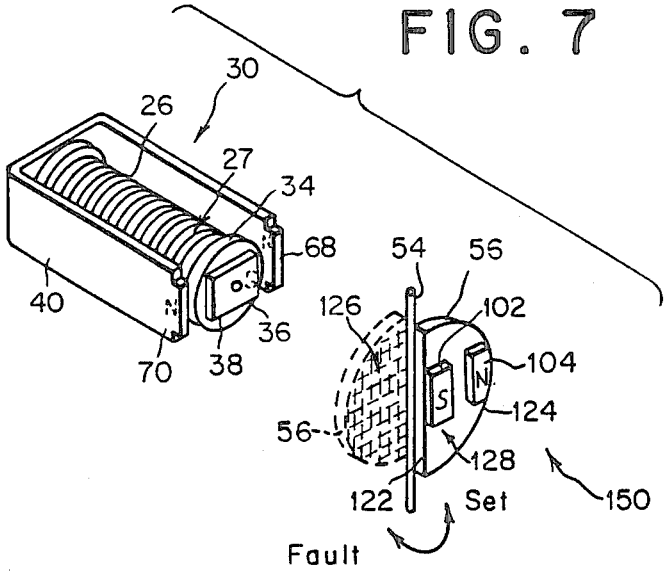
FIG. 7 is a simplified perspective drawing of another embodiment of the indicator of the present invention.

FIG. 7 is a simplified drawing of another embodiment of the indicator of the present invention. Although only magnetic assembly 30 and flag assembly 150 are shown in FIG. 7, the remainder of the indicator is the same as in the embodiment shown in FIGS. 1, 2 and 3. In FIG. 7 semicircular flag 56 is shown in the "set" position in solid lines and in the "fault" position in broken lines. In this embodiment, only two flag magnets are used. Central flag magnet 102 is attached to flag 56 adjacent the straight edge of flag 56. Outer flag magnet 104 is attached to flag 56 along the curved edge of flag 56 as shown in FIG. 7.

Flag magnets 102, 104 are magnetized in a fashion similar to the way flag magnets 58, 60, 62 are magnetized in the embodiment shown in FIGS. 1, 2, and 3, so that the surfaces in contact with flag 56 have one pole while the other surfaces of the magnets have opposite poles. The embodiment shown in FIG. 7 also differs from that shown in FIG. 1 in that the axis of rotation of pivot shaft 54 shown in FIG. 7 is rotated 90° from that shown in FIG. 1.

In operation, when power source 80 is connected to coil 27, the various elements are magnetized so that when flag 56 is in the "set" position, outer flag magnet 104 is attracted to end 68, and central flag magnet 102 is attracted to core bar 38, and so that when flag 56 is in the "fault" position, outer flag magnet 104 is attracted to end 70, and central flag magnet 102 is attracted core bar 38.

In the embodiment shown in FIG. 8 in which only flag assembly 150 is shown, arm 110 is fixedly connected to pivot shaft 54 to act as a counter-weight to flag 56 and the flag magnets attached thereto. Thus, when flag 56 rotates from one indicator position to the other, arm 110 also rotates. End portion 14 is provided with a hole (not shown) with an appropriate size and shape so that the rotation of arm 110 is not impeded.

While the invention has been described in conjunction with the specific embodiments, it is evident that numerous alternatives, modifications, and variations will be apparent to those skilled in the art in the light of the foregoing description.

For example, the poles of all the flag magnets can be reversed so that all north (N) poles are south (S) poles and all south (S) poles are north (N) poles.

Additionally, flag 56 can have other shapes or can alternatively be replaced by more than one flag each of which being operated by the same magnetic assembly 30 or by separate magnetic assemblies so that when the coil(s) of the magnetic assembly (assemblies) is (are) activated, the flags flip from one position to the other position. If more than one magnetic assembly is used, the magnetic assemblies can also be selectively activated to cause only certain flags to change position, thereby resulting in a distinctive pattern associated with a particular condition of a monitored device.

What is claimed is:

1. An electromagnetic indicator for providing binary indication of first and second conditions comprising:

a housing;

a flag assembly rotatably mounted in said housing so that said flag assembly is rotatable between a first and a second position, said first position indicating said first condition and said second position indicating said second condition, said flag assembly being permanently magnetized in at least one portion;

magnetic latching means comprising bracket means having a first end and a second end, and a core bar means, said bracket and core bar means being mounted within said housing so that said ends of said bracket and core bar means are near said flag assembly;

electromagnetic means mounted within said housing, said electromagnetic means comprising at least one electromagnet having a core and a winding therearound, said electromagnetic means having first and second ends, said bracket means being magnetically connected to said first end of said electromagnetic means, said second end of said electromagnetic means being magnetically connected to said core bar means and being near said flag assembly, said winding being connectable to an electrical power source so that when said electromagnetic means is connected to said electrical power source said electromagnetic means is able to generate a magnetic field whereupon said bracket means, said ends of said bracket means and said core bar means become magnetized to produce a magnetic field, the magnetic field of said ends of said bracket means and said core bar means interacting with the magnetic field of said magnetized portion of said flag assembly to cause said flag assembly to rotate from said first position to said second position and become magnetically latched in said second position by the magnetic attraction between said ends of said bracket means and said core bar means and said magnetized portion of said flag assembly, or to cause said flag assembly to rotate from said second position to said first position and become magnetically latched in said first position by the magnetic attraction between said ends of said bracket means and said core bar means and said magnetized portion of said flag assembly, said magnetic latching to continue after said electromagnetic means is disconnected from said electrical power source.

2. The electromagnetic indicator of claim 1 wherein said flag assembly comprises:

a pivot shaft rotatably mounted in said housing; and a flag member fixedly connected to said pivot shaft, so as to rotate therewith;

wherein said magnetized portion comprises at least one flag magnet mounted on said flag member.

3. The electromagnetic indicator of claim 2 wherein said first and second ends of said bracket means are near said second end of said electromagnetic means.

4. The electromagnetic indicator of claim 3 wherein said flag member has a semicircular shape having a straight edge and a curved edge, said pivot shaft being connected to said flag member along its straight edge.

5. The electromagnetic indicator of claim 4 wherein:

said pivot shaft rotates on an axis that is perpendicular to a line that connects said two ends of said bracket means; and said first end of said bracket means is positioned in said housing so as to be adjacent to said magnetized portion of said flag assembly when said flag assembly is in said first position, and said second end of said bracket means is positioned in said housing so as to be adjacent to said magnetized portion of said flag assembly when said flag assembly is in said second position.

6. The electromagnetic indicator of claim 5 wherein said magnetized portion comprises an outer flag magnet and a central flag magnet, said outer flag magnet being positioned on said semicircular flag member near its curved edge so that said outer flag magnet is adjacent to said first end of said bracket means when said flag assembly is in said first position and adjacent to said second end of said bracket means when said flag assembly is in said second position, said central flag magnet being positioned on said flag member adjacent to said straight edge of said flag member so that said central flag magnet is adjacent to said second end of said electromagnetic means.

7. The electromagnetic indicator of claim 6 wherein said flag assembly further comprises an arm fixedly connected to said pivot shaft so as to act as a counterweight to said flag member.

8. The electromagnetic indicator of claim 4 wherein:

said pivot shaft rotates on an axis that is parallel to a line that connects said two ends of said bracket means; and said magnetized portion of said flag member comprises three flag magnets positioned in a line adjacent to said straight edge of said semicircular flag member so that a first flag magnet is adjacent to said first end of said bracket, so that a second flag magnet is adjacent to said second end of said electromagnetic means, and so that a third flag magnet is adjacent to said second end of said bracket means.

9. The electromagnetic indicator of claim 8 wherein said flag assembly further comprises an arm fixedly conected to said pivot shaft so as to act as a counterweight to said flag member.

10. The electromagnetic indicator of claim 4 wherein:

said pivot shaft rotates on an axis that is parallel to a line that connects said ends of said bracket means; and said magnetized portion comprises a flag magnet having three magnetized sections positioned in a line adjacent to said straight edge of said semicircular flag member so that a first magnetized section is adjacent to said first end of said bracket means, so that a second magnetized section is adjacent to said second end of said electromagnetic means, and so that a third magnetized section is adjacent to said second end of said bracket means.

11. The electromagnetic indicator of claim 10 wherein said flag assembly further comprises an arm fixedly connected to said pivot shaft so as to act as a counterweight to said flag member.

12. An electromagnetic indicator for providing binary indication of first and second conditions comprising:

a housing;

magnetic latching means comprising bracket means having a first end and a second end, and a core bar means, said bracket and core bar means being mounted within said housing;

a flag assembly rotatably mounted in said housing near said ends of said bracket and core bar means so that said flag assembly is rotatable between a first and a second position, said first position indicating said first condition and said second position indicating said second condition, said flag assembly having a pivot shaft rotatably mounted in said housing on an axis that crosses said core bar means, a flag member fixedly connected to said pivot shaft so as to rotate therewith, and at least one permanently magnetized portion mounted on said flag member;

electromagnetic means mounted within said housing, said electromagnet means comprising at least one electromagnet having a core and a winding therearound, said electromagnetic means having first and second ends, said bracket means being magnetically connected to said first end of said electromagnetic means, and second end of said electromagnetic means being magnetically connected to said core bar means and being near said flag assembly, said winding being connectable to an electrical power source so that when said electromagnetic means is connected to said electrical power source said electromagnetic means is able to generate a magnet field whereupon said bracket means, said ends of said bracket means and said core bar means become magnetized to produce a magnetic field, the magnetic field of said ends of said bracket means and said core bar means interacting with the magnetic field of said magnetized portion of said flag assembly to cause said flag assembly to rotate from said first position to said second position and become magnetically latched in said second position by the magnetic attraction between said ends of said bracket means and said core bar means and said magnetized portion of said flag assembly, or to cause said flag assembly to rotate from said second position to said first position and become magnetically latched in said first position by the magnetic attraction between said ends of said bracket means and said core bar means and said magnetized portion of said flag assembly, said magnetic latching to continue after said electromagnetic means is disconnected from said electrical power source.

13. The indicator of claim 12 wherein the axis of said pivot shaft extends between the two ends of said bracket means.

14. The indicator of claim 12 wherein the axis of said pivot shaft is perpendicular to a line that extends between the two ends of said bracket means.

15. The indicator of claim 12 wherein the axis of said pivot shaft is perpendicular to a longitudinal axis of said housing.

16. An electromagnetic indicator for providing binary indication of first and second conditions comprising:

a housing;

magnetic latching means comprising bracket means having a first end and a second end, and a core bar means, said bracket and core bar means being mounted within said housing;

a flag assembly rotatably mounted in said housing near said ends of said bracket and core bar means so that said flag assembly is rotatable between a first and a second position, said first position indicating said first condition and said second position indicating said second condition, said flag assembly having a pivot shaft rotatably mounted in said housing on an axis that is parallel to a line that connects said two ends of said bracket means, a flag member fixedly connected to said pivot shaft so as to rotate therewith, and at least one permanently magnetized portion mounted on said flag member;

electromagnetic means mounted within said housing, said electromagnet means comprising at least one electromagnet having a core and a winding therearound, said electromagnetic means having first and second ends, said bracket means being magnetically connected to said first end of said electromagnetic means, said second end of said electromagnetic means being magnetically connected to said core bar means and being near said flag assembly, said winding being connectable to an electrical power source so that when said electromagnetic means is connected to said electrical power source said electromagnetic means is able to generate a magnet field whereupon said bracket means, said ends of said bracket means and said core bar means become magnetized to produce a magnetic field, the magnetic field of said ends of said bracket means and said core bar means interacting with the magnetic field of said magnetized portion of said flag assembly to cause said flag assembly to rotate from said first position to said second position and become magnetically latched in said second position by the magnetic attraction between said ends of said bracket means and said core bar means and said magnetized portion of said flag assembly, or to cause said flag assembly to rotate from said second position to said first position and become magnetically latched in said first position by the magnetic attraction between said ends of said bracket means and said core bar means and said magnetized portion of said flag assembly, said magnetic latching to continue after said electromagnetic means is disconnected from said electrical power source.

17. The electromagnetic indicator of claim 16 wherein said first and second ends of said bracket means are near said second end of said electromagnetic means.

18. The electromagnetic indicator of claim 17 wherein said flag member has a semicircular shape having a straight edge and a curved edge, said pivot shaft being connected to said flag member along its straight edge.

19. The electromagnetic indicator of claim 18 wherein said magnetized portion of said flag member comprises three flag magnets positioned in a line adjacent to said straight edge of said semicircular flag member so that a first flag magnet is adjacent to said first end of said bracket, so that a second flag magnet is adjacent to said second end of said electromagnetic means, and so that a third flag magnet is adjacent to said second end of said bracket means.

20. The electromagnetic indicator of claim 19 wherein said flag assembly further comprises an arm fixedly connected to said pivot shaft so as to act as a counterweight to said flag member.

21. An electromagnetic indicator for providing binary indication of first and second conditions comprising:

a housing;

magnetic latching means comprising bracket means having a first end and a second end, and a core bar means, said bracket and core bar means being mounted within said housing;

a flag assembly rotatably mounted in said housing near said ends of said bracket and core bar means so that said flag assembly is rotatable between a first and a second position, said first position indicating said first condition and said second position indicating said second condition, said flag assembly having a pivot shaft rotatably mounted in said housing on an axis that is perpendicular to a line that connects said two ends of said bracket means, a flag member fixedly connected to said pivot shaft so as to rotate therewith and at least one permanently magnetized portion mounted on said flag member;

electromagnetic means mounted within said housing, said electromagnetic means comprising at least one electromagnet having a core and a winding therearound, said electromagnetic means having first and second ends, said bracket means being magnetically connected to said first end of said electromagnetic means, said second end of said electromagnetic means being magnetically connected to said core bar means and being near said flag assembly, said winding being connectable to an electrical power source so that when said electromagnetic means is connected to said electrical power source said electromagnetic means is able to generate a magnet field whereup said bracket means, said ends of a said bracket means and said core bar means become magnetized to produce a magnetic field, the magnetic field of said ends of said bracket means and said core bar means interacting with the magnetic field of said magnetized portion of said flag assembly to cause said flag assembly to rotate from said first position to said second position and become magnetically latched in said second position by the magnetic attraction between said ends of said bracket means and said core bar means and said magnetized portion of said flag assembly, or to cause said flag assembly to rotate from said second position to said first position and become magnetically latched in said first position by the magnetic attraction between said ends of said bracket means and said core bar means and said magnetized portion of said flag assembly, said magnetic latching to continue after said electromagnetic means is disconnected from said electrical power source.

22. The electromagnetic indicator of claim 21 wherein said first and second ends of said bracket means are near said second end of said electromagnetic means.

23. The electromagnetic indicator of claim 22 wherein said flag member has a semicircular shape having a straight edge and a curved edge, said pivot shaft being connected to said flag member along its straight edge.

24. The electromagnetic indicator of claim 23 wherein said first end of said bracket means is positioned in said housing so as to be adjacent to said magnetized portion of said flag assembly when said flag assembly is in said first position, and said second end of said bracket means is positioned in said housing so as to be adjacent to said magnetized portion of said flag assembly when said flag assembly is in said second position.

25. The electromagnetic indicator of claim 24 wherein said magnetized portion comprises an outer flag magnet and a central flag magnet, said outer flag magnet being positioned on said semicircular flag member near its curved edge so that said outer flag magnet is adjacent to said first end of said bracket means when said flag assembly is in said first position and adjacent to said second end of said bracket means when said flag assembly is in said second position, said central flag magnet being positioned on said flag member adjacent to said straight edge of said flag member so that said central flag magnet is adjacent to said second end of said electromagnetic means.

26. The electromagnetic indicator of claim 25 wherein said flag assembly further comprises an arm fixedly connected to said pivot shaft so as to act as a counterweight to said flag member.

* * * * *